United States Patent [19]

Goddard et al.

[11] 4,331,511

[45] May 25, 1982

[54] PAPER MAKING MACHINE FOIL HAVING LOW DISTURBANCE PROFILE AND SELF-SHARPENING TIP

[75] Inventors: Denis A. Goddard; Robert L. Wallis, both of Beloit, Wis.

[73] Assignee: Beloit Corporation, Beloit, Wis.

[21] Appl. No.: 148,368

[22] Filed: May 9, 1980

[51] Int. Cl.[3] ..... D21F 1/54; D21F 7/00

[52] U.S. Cl. ..... 162/352; 162/374; 425/182

[58] Field of Search ..... 162/352, 374; 425/84, 425/85, 182, 183

[56] References Cited

U.S. PATENT DOCUMENTS

| | | | |
|---|---|---|---|
| 2,928,465 | 3/1960 | Wrist | 162/352 |
| 3,446,702 | 5/1969 | Buchanan | 162/374 |
| 3,732,142 | 5/1973 | Beacom et al. | 162/374 |
| 3,738,911 | 6/1973 | Kienzl et al. | 162/374 |
| 3,778,342 | 12/1973 | Charbonneau | 162/352 |
| 3,870,597 | 3/1975 | Getman et al. | 162/352 |
| 3,928,125 | 12/1975 | Poeschl | 162/352 |
| 4,004,969 | 1/1977 | Beauchemin | 162/352 |
| 4,134,788 | 1/1979 | Witworth | 162/352 |

OTHER PUBLICATIONS

Hydrofoil Design and Application Is An Evolving Science, Thorp, Paper Trade Journal, 1/11/65.

*Primary Examiner*—Marc S. Alvo

*Attorney, Agent, or Firm*—Hill, Van Santen, Steadman, Chiara & Simpson

[57] ABSTRACT

A paper making machine foil is provided with one or more of the following: a narrow angle (from 14° to 23°) forwardly projecting doctoring nose providing a water skimming edge, a layer of wear resisting material spaced rearwardly from the skimming edge and a wear resisting facing on and along an under surface of the nose and providing a self-sharpening water stripping tip for the skimming edge, and a metal (stainless steel) body provided with a downwardly opening recess within which is mounted a mounting member (rigid plastic) having a downwardly opening shaped groove receptive of a sliding connection for mounting the foil in a paper making machine.

8 Claims, 3 Drawing Figures

FIG. 1
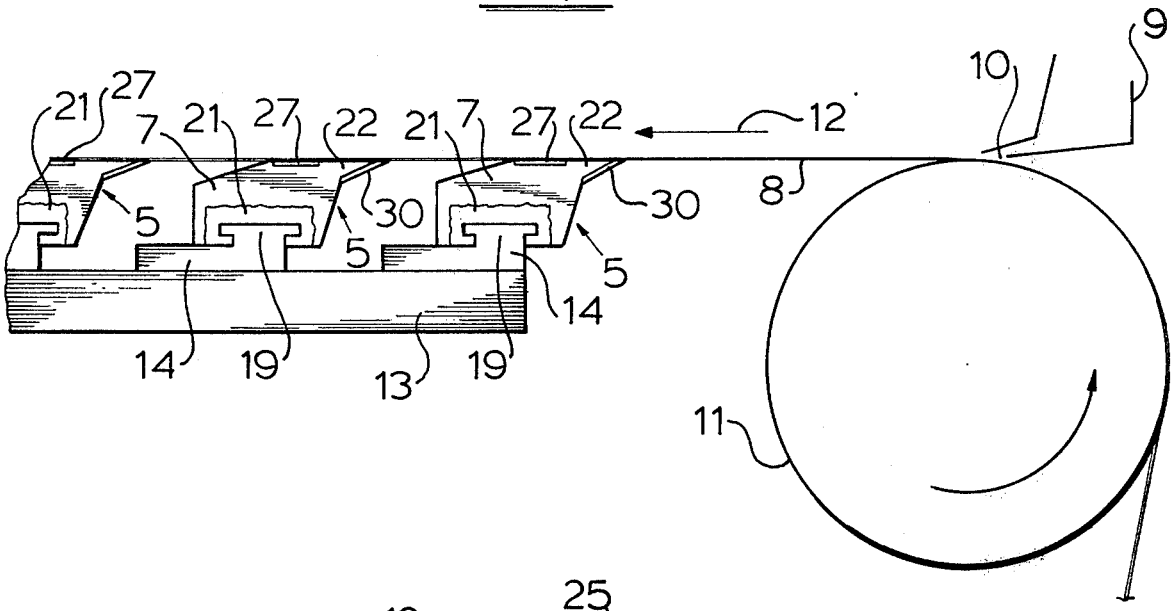
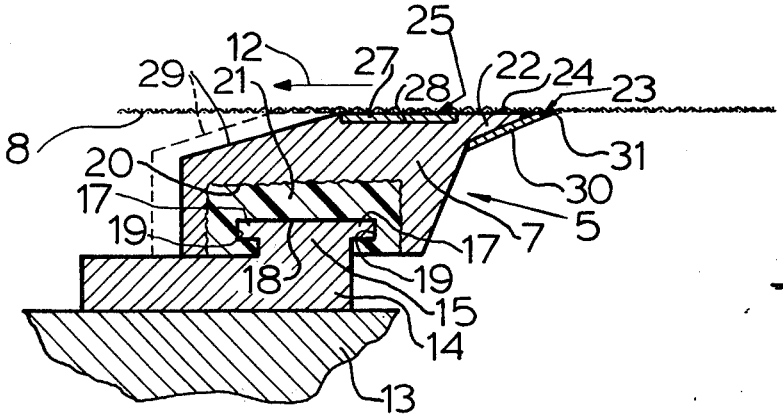
FIG. 2
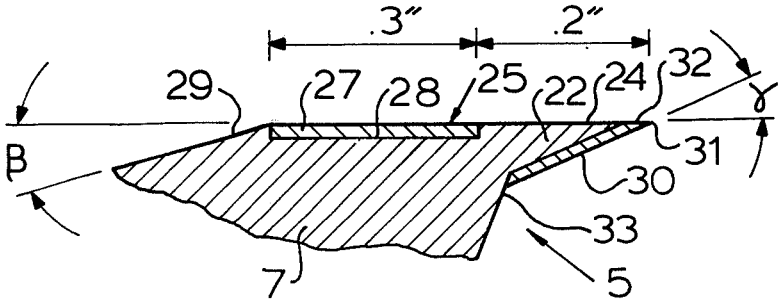
FIG. 3

PAPER MAKING MACHINE FOIL HAVING LOW DISTURBANCE PROFILE AND SELF-SHARPENING TIP

BACKGROUND OF THE INVENTION

This invention relates to improvements in paper making machine foils which are commonly used in the forming sections of paper making machines, such as of the fourdrinier type wherein water is removed through a wire on which the fiber-water slurry has been deposited. The foil blades are applied to the underside of the wire and have leading side water stripping edges and trailing foiling surfaces, that is surfaces which by angling away from the on-running wire exert negative pressure to draw water through the wire for stripping by the next succeeding foil leading edge.

Numerous and sundry prior foil structures have been proposed to meet problems relating to mounting of the foils, resisting wear at the dewatering tip or on top of the foil and the like.

With increase in machine operating speeds in the constant effort to increase machine productivity, problems relating to the dewatering foils have become more pronounced, and in some instances problems, which at slower speeds have either not been recognized or have been of such little consequence as to be ignored, now have assumed major importance.

By way of example of various attempts to solve one or more problems in dewatering foils, reference is made to the following U.S. Pat. Nos. 3,446,702; 3,732,142; 3,738,911; 4,004,969; 4,134,788 provide a wear surface back of the blade tip but ignore wear of the relatively soft surface of the tip configuration which is easily lost and the blade rendered useless in a comparatively short time.

U.S. Pat. No. 3,778,342 discloses an almost impossible approach from a manufacturing standpoint, although addresses the problem of providing a wear resistant tip but ignores the protection of the upper land portion back of the tip.

U.S. Pat. No. 3,793,140 although providing a wear resistant tip is not usable on a high speed machine because of the arcuate top surface of the tip.

U.S. Pat. No. 3,870,597 provides a removable tip insert but provides no wear resistance for the doctor tip nor wear resistance protection on the rearward land surface.

A salient deficiency with respect to all of the foregoing patents, in addition to shortcomings already mentioned, is that none of the patentees apparently recognized how the wire fabric and the foils react at high speed.

From a study of the wear patterns on existing foil designs, it has been noted that wear takes place in the dewatering or skimming tip and at a point about one-half inch back from the tip. As water rejection occurs below the tip, the phenomenon of stagnation or flow reversal tends to occur as the water drops down from the skimming tip. This causes the forming wire to lift off of the foreward part of the blade tip and then to touch downstream from the tip. Back pressure is somewhat dependent on how much the water stream under the wire is changed in direction. Because of the high angle, generally about 60° between the top of the blade tip and the foreward sloping face of the foil body, all of the above listed patent structures are subject to the stagnation pressure to at least a substantial degree, and thus inefficient at high machine speeds.

Another problem of some magnitude encountered in the prior foil structures is involved in the means for mounting the foil blades. While the patents disclose connections such as dovetail, T-bar, and the like which enable easy slide on and off of the blades with respect to their mountings, the various structures heretofore have presented various machining problems and/or sacrifice in foil body strength.

SUMMARY OF THE INVENTION

It is therefore an important object of the present invention to overcome the disadvantages, drawbacks, inefficiencies, shortcomings and problems inherent in prior paper-making machine dewatering foil structures.

Another object of the invention is to provide a new and improved foil structure which has a very low water deflection angle to reduce the pressure and forces at the blade tip to a minimum.

A further object of the invention is to provide new and improved wear resistance for a relatively soft foil body.

Still another object of the invention is to provide a new and improved long wearing, self-sharpening foil structure.

Yet another object of the invention is to provide a new and improved foil structure which affords substantial economies in structure and in the fabrication capabilities of the structure.

The invention provides a paper making machine foil having an elongate body having means adapting the body to be mounted in cross machine direction under a traveling forming wire for promoting water removal from paper stock carried by the wire, said foil comprising a narrow angle forwardly projecting doctoring nose extending along said body and terminating in a leading water skimming edge arranged to project opposite to the direction of travel of said forming wire, said nose having an upper surface comprising part of a wire supporting land surface on top of said body, a layer of wear resisting material within the plane of said land surface, said layer having its leading boundary spaced from said skimming edge so that at least an area of said upper surface of said nose intervening between said edge on said leading boundary exposes material of said body to the bottom surface of said wire, a negative pressure inducing foil surface on said body sloping downwardly away from said land surface rearwardly relative to the trailing boundary of said wear resisting material layer, and a wear resisting facing on and along an under surface of said nose and extending from said skimming edge obliquely downwardly and rearwardly. The under surface facing is substantially harder than the material of the body and has an upper edge portion providing a wear resistant self-sharpening water stripping tip for the skimming edge located substantially in the plane of the upper surface area of the nose. The upper surface area of the nose by virtue of being a softer material than the upper edge portion of the facing facilitates self-sharpening of the tip by action of the bottom surface of the travelling wire.

In a preferred construction, the nose of the foil has a low or narrow angle of about 14° to 23° between the upper land surface and the under surface of the nose, thereby greatly dimishing tendency toward stagnation, turbulence, flow reversal by the rejected water below the water stripping tip of the foil.

In a preferred construction, the foil has a body of suitable metal, such as stainless steel provided with a bottom cavity in which is mounted a rigid plastic insert suitably recessed for slidable on-off mounting of the foil on a slide connection on foil supporting means.

BRIEF DESCRIPTION OF THE DRAWINGS

Other objects, features and advantages of the invention will be readily apparent from the following description of certain representative embodiments thereof, taken in conjunction with the accompanying drawing although variations and modifications may be effected without departing from the spirit and scope of the novel concepts embodied in the disclosure and in which:

FIG. 1 is a schematic side elevational view of a paper making machine having dewatering foils embodying the invention;

FIG. 2 is an enlarged transverse vertical sectional view through one of the foils showing details of structural parts; and FIG. 3 is a further enlarged fragmentary sectional detail view of the upper portion of one of the foils of the present invention.

DETAILED DESCRIPTION OF THE PREFERRED EMBODIMENTS

Paper making machine foils 5 (FIG. 1) have respective elongate bodies 7 adapted to be mounted in cross machine direction under a travelling forming wire 8 for promoting water removal from paper stock carried by the wire. The paper stock is adapted to be supplied to the wire in any preferred manner such as from a head box 9 through a slice 10 designed to apply a continuous substantially uniform layer of paper stock in a water slurry to the upper surface of the wire 8 which may be presented to the slice 10 by running theretoward on the perimeter of a guide roll 11 which may be a suction roll to assist in preliminary withdrawal of water from the slurry through the wire 8. It will be understood that the wire 8 may be of the fourdrinier type in the form of an endless wire belt, many feet wide and driven at a high rate of speed, running from the rotating roll 11 and the slice 10 in the direction of the directional arrow 12.

Means are provided for mounting each of the foils 5, and more particularly the foil body 7 in each instance on supporting means 13 (FIGS. 1 and 2) which may be a part of the machine frame or other suitable supporting structure, such as the top of a suction box, water receiver, or the like. In a desirable arrangement, the mounting means comprises a slidable connection which may be of conventional dovetail or T-shape whereby the foils 5 can be slidably mounted in place in cross machine direction either as continuous elongate strips or in end-to-end sections, as is customary, permitting changing the foils on the run at any time in the paper making forming zone under the wire 8. For this purpose, the support 13 carries fixedly thereon for each of the foils 5 a respective mounting bar 14 having an upwardly projecting sliding connection rib 15 extending therealong and throughout the full cross machine span having regard to the width of the wire 8. In one preferred form, the rib 15 has a head of T-cross section defined by oppositely projecting flanges 17, and the rib 15 and flanges 17 are received in a complementary endwise opening groove 18 extending longitudinally in the bottom of the body 7 and provided with undercut slots 19 receptive of the flanges 17.

In an economical construction, the foil body 7 is adapted to be made from a corrosion resistant metal such as stainless steel having a longitudinally extending and downwardly opening recess 20 therein of substantially greater dimensions than the groove 18. The walls defining the recess 20 need only be rough machined with substantial tolerance. Filling the recess 20 is a rigid plastic insert member 21 which may be preformed and assembled in the recess 20 and bonded or otherwise permanently fixed therein. If preferred the insert 21 may be molded and thus secured in situ in the recess 20. In any event, the T-groove 18 is formed in the plastic insert 21 by machining; or where the insert is a preformed extruded strip, the groove 18 can be readily molded therein. This provides a substantial economic improvement in the structure because it is easier and less costly to produce the T-slot 18 in the plastic insert 21 than to machine such a groove or slot in a metal part. Further, the plastic insert is less effected by temperature differentials, and serves as a cushioning and sound damping medium between the bar 15 and the foil body 7. Plastic material for the insert 21 may be of any preferred type suitable for the purpose. One such material is the plastic identified as Beltex which is a proprietary product of Beloit Corporation, Beloit, Wisconsin.

Each of the foils 5 is constructed for efficiently cooperating with the bottom of the travelling forming wire 8 in promoting water removal from the paper stock mat carried by the wire. For this purpose, the body 7 of each of the foils 5 has a narrow angle forwardly projecting doctoring nose 22 extending along the body and terminating in a leading water skimming edge 23 arranged to project opposite to the direction of travel of the forming wire 8. The nose 22 has an upper surface 24 which comprises part of a wire supporting land 25 on top of the body 7. A layer 27 of wear resisting material 27 is located within the plane of the land surface 25, desirably in a recess 28. The layer 27 has its leading boundary spaced from the skimming edge 23 so that at least an area of the upper surface 24 intervenes between the edge 23 and the leading boundary and exposes material of the body 7 to the bottom surface of the wire 8.

Sloping downwardly and rearwardly away from the land surface 25 and rearwardly relative to the trailing boundary of the wear resisting material layer 27 is a negative pressure inducing foil. The angle ($\beta$ in FIG. 3) of the surface 29 relative to the land surface 25 may be up to 15° and has the function of inducing negative pressure acting to cause entrained water to flow through the wire 8 for promoting dewatering of the fibrous mat on the top surface of the wire. Although the surface 29 may lead off downwardly directly from the rear boundary of the layer 27, the land surface 25 may extend in a continuous plane rearwardly from the layer 27 as shown in dash outline in FIG. 2 and the surface 29 sloping away from the land surface 25 commencing at a point spaced from the rear boundary of the layer 27.

A wear resisting facing 30 is provided on and along an under surface of the nose 22 and extends from the skimming edge 23 obliquely downwardly and rearwardly. The wear resisting facing 30, similarly as the wear resisting layer 27 is formed from a substantially harder material than the material of the body 7. An upper edge portion of the facing 30 provides a wear resistant self-sharpening water stripping tip 31 for, and substantially complementary to, the skimming edge 23. The facing has a substantially constant thickness along the under surface of the nose 22 and the thickness is substantially less than the width of the downwardly and rearwardly extending land surface 25. The tip 31 is located substantially in the plane of the nose top surface area 24. To assure this relationship, the upper edge of the layer 30 is desirably chamfered in a plane with the nose top surface area 24 and the tip 31. Through this arrangement, the upper surface area 24, by virtue of being a softer material than the upper edge portion of the facing 30 and particularly the chamfer 32 and the tip 31, facilitates self-sharpening of the tip 31 by action of the bottom surface of the travelling wire. Nevertheless, undue wearing of the surface 24 is precluded by the wear resistant layer 27 which assumes the principal burden of any wearing action on the land surface 25 that may be imposed in operation by the wire 8.

Both of the wear resisting layer 27 and the wear resisting facing 30 are desirably formed from an abrasion resisting material such as tungsten carbide applied as a coating to the desired surfaces of the body 7. By way of example, the depth and width of the recess 28 in which the layer 27 is mounted may be about 0.015" deep and about 0.3" wide. The layer 27 therefore should be of the same dimensions and with its top surface flush with the surface area 24. The surface area 24 inclusive of the chamfer 32 is desirably about 0.2" in width, as indicated in FIG. 3.

Desirably the facing 30 may be applied as a tungsten carbide coating of about 0.005" thickness and about 0.2" wide having its lower edge abutting or shouldering against a forwardly facing surface 33 of the body 7 slopping downwardly and rearwardly from juncture with the under surface of the nose 22. This relieves the layer 30 from shear stresses that may be imposed in its plane by contact of the upper edge surface 32 with the bottom surface of the running wire 8.

By substantially improved construction of the nose 22, with a very low water deflection angle, i.e. angle $\alpha$ (FIG. 3) of about 14° to 23° (as contrasted to conventional about 60°) flow reversal of skimmed water below the tip 31 is substantially avoided or at least greatly minimized, thus substantially relieving the wire 8 from deflection ahead of the tip 21. This avoids or at least minimizes separation of the travelling wire from the supporting land 25 and assures that both drag and disruption of movement of the wire over the foil 5 will be kept to a minimum. Nevertheless, the differential wear by reason of differential hardness in the surface area 24 and the chamfer surface 32 will assure self-sharpening to keep the tip 31 sharp and thus of maximum water stripping or skimming efficiency. By reason of the low angle, i.e. narrow, of the under surface of the nose 22 relative to the top plane of the nose provided by the surface 24, skimmed water will be diverted smoothly and with minimum tendency toward turbulence or stagnation rearwardly away from the tip 31 and then flows down the surface 33.

It will be understood that variations and modifications may be effected without departing from the spirit and scope of the novel concepts of this invention.

We claim as our invention:

1. A paper making machine foil having an elongate body having means adapting the body to be mounted in cross machine direction under a travelling forming wire for promoting water removal from paper stock carried by the wire, said foil comprising:

a narrow angle forwardly projecting doctoring nose extending along said body and terminating in a leading water skimming edge arranged to project opposite to the direction of travel of said forming wire;

said nose having an upper surface comprising part of a wire supporting land surface on top of said body;

a layer of wear resisting material within the plane of said land surface, said layer having a leading boundary spaced from said skimming edge so that at least an area of said upper surface of said nose intervening between said edge and said leading boundary exposes material of said body to the bottom surface of said wire;

a negative pressure inducing surface on said body sloping downwardly away from said land surface rearwardly relative to the trailing boundary of said wear resisting material layer;

and a wear resisting facing on and along an under surface of said nose and extending in width from said skimming edge obliquely downwardly and rearwardly, and wherein the angle between said top surface of said nose and said under surface of said nose is about 14° to 23°, said wear resisting facing being substantialy harder than said material of said body and having an upper edge portion providing a wear resistant water stripping, sharp tip for said skimming edge said tip being self-sharpening and located substantially in the plane of said top surface of said nose, said wear resisting face being of substantially constant thickness along the under surface of said nose and said thickness being substantially less than the width of the downwardly and rearwardly extending land surface, and wherein said upper edge portion of said facing has a chamfer from said tip and lying in substantially the plane of said top surface of said nose;

said upper surface area by virtue of being a softer material than said upper edge portion of said facing facilitating self-sharpening of said tip by action of the bottom surface of the travelling wire.

2. A paper making machine foil according to claim 1, wherein said body has a downwardly and rearwardly sloping surface extending from juncture with the lower end of said under surface of the nose and serving to divert downwardly skimmed water flowing theretoward along said under surface of said nose and providing shoulder means on said body along the lower edge of said facing and serving to relieve the facing from shear forces in its plane imposed by the travelling forming wire against said upper edge portion of said facing.

3. A paper making machine foil according to claim 1, wherein said land surface has a recess therein within which said layer is mounted, and said facing comprises a layer of wear resisting material applied to substantially the entire under surface of said nose.

4. A paper making machine foil according to claim 1, including means against which the lower edge of said facing shoulders and relieves the facing from shear stresses in its plane from contact of said upper edge portion with said forming wire.

5. A paper making machine foil according to claim 1, wherein said body has a downwardly opening recess, and means mounted in said recess providing a groove which opens endwise for receiving a complementary slide connection for mounting the foil in place relative to the forming wire.

6. A paper making machine foil according to claim 5, wherein said means mounted in said recess comprises a plastic member, said recess being defined by rough machined surfaces, said plastic member being secured to said rough machined surfaces.

7. A paper making machine foil according to claim 5, wherein said means within said recess comprises a rigid plastic member, said body comprises stainless steel, and said layer and said facing comprise tungsten carbide.

8. A paper making machine foil having an elongate body provided with means adapting the body to be mounted in cross machine direction under a travelling forming wire for promoting water removal from paper stock carried by the wire, said body having a top wire supporting land surface and a negative pressure inducing foil surface sloping downwardly away from said land surface, the improvement comprising:

a narrow angle forwardly projecting doctoring nose extending along said body and terminating in a leading water skimming edge arranged to project opposite to the direction of travel of said forming wire;

said nose having an upper surface in a plane with said land surface and an under surface extending from said skimming edge obliquely downwardly and rearwardly;

and the angle between said upper surface and said under surface being substantially about 14° to 23° so that in water skimming operation of the foil relative to said forming wire stagnation and turbulence of skimmed water under said nose is substantially avoided;

a downwardly and rearwardly sloping skimmed water guide surface on said body below the lower edge of said nose under surface;

a layer of wear resisting material within the plane of said land surface and having its leading boundary spaced from said skimming edge so that at least an area of said upper surface of said nose intervenes between said edge and said leading boundary and thereby exposes material of said body to the bottom surface of said wire;

and a wear resisting facing on and along said under surface of said nose and extending in width from said skimming edge obliquely downwardly and rearwardly;

said wear resisting facing being substantially harder than said material of said body and having an upper edge portion providing a wear resistant water stripping, sharp tip for said skimming edge, so that said upper surface area by virtue of being a softer material than said upper edge portion of said facing facilitates self-sharpening of said tip by action of the bottom surface of the travelling wire, said wear resisting face being of substantially constant thickness along the under surface of said nose and said thickness being substantially less than the width of the downwardly and rearwardly extending land surface, and wherein said upper edge portion of said facing has a chamfer from said tip and lying in substantially the plane of said top surface of said nose.

* * * * *